US005253022A

United States Patent [19]

Takeuchi et al.

[11] Patent Number: 5,253,022

[45] Date of Patent: Oct. 12, 1993

[54] IMAGE FORMING APPARATUS

[75] Inventors: Akihiko Takeuchi; Takayasu Yuminamochi, both of Yokohama; Hiroto Hasegawa, Kawasaki; Koichi Tanigawa, Tokyo; Yasumasa Ohtsuka, Yokohama; Hiroki Kisu, Ichikawa, all of Japan

[73] Assignee: Canon Kabushiki Kiasha, Tokyo, Japan

[21] Appl. No.: 524,024

[22] Filed: May 15, 1990

[30] Foreign Application Priority Data

May 18, 1989 [JP] Japan ..... 1-122868
Aug. 10, 1989 [JP] Japan ..... 1-205696

[51] Int. Cl.[5] ..... G03G 15/16

[52] U.S. Cl. ..... 355/274; 355/208; 355/219; 355/271; 355/273; 355/215

[58] Field of Search ..... 355/271, 273, 274, 275, 355/276, 277, 215, 208, 219; 361/220, 221, 225

[56] References Cited

U.S. PATENT DOCUMENTS 4,977,430 12/1990 Florack et al. ..... 355/274
5,132,738 7/1992 Nakamura et al. ..... 355/274
5,182,604 1/1993 Asai ..... 355/273
5,196,885 3/1993 Takeuchi et al. ..... 355/219

FOREIGN PATENT DOCUMENTS 0056674 3/1988 Japan ..... 355/274
0088582 4/1988 Japan ..... 355/274
0319078 12/1989 Japan ..... 355/274
0039181 2/1990 Japan ..... 355/274
0039182 2/1990 Japan ..... 355/274
0123385 5/1990 Japan .
2204508 11/1988 United Kingdom ..... 355/274

*Primary Examiner*—A. T. Grimley
*Assistant Examiner*—Matthew S. Smith
*Attorney, Agent, or Firm*—Fitzpatrick, Cella, Harper & Scinto

[57] ABSTRACT

An image forming apparatus includes a movable image bearing member; an image forming device for forming a toner image on the image bearing member; an image transfer device for transferring the toner image onto a transfer material at a transfer position, the transfer device including a rotatable member contactable to such a side of the transfer material as is opposite from a side contactable to the image bearing member and an electric field forming device for forming an electric field between the image bearing member and the rotatable member; wherein the electric field forming device forms a first electric field effective to transfer the toner from the rotatable member to the image bearing member and a second electric field which is opposite in a direction from the first electric field during a period in which the transfer material is absent at the transfer position, wherein each of the first and second electric fields is formed at least for a period required for the entire surface of the rotatable member passes through the transfer position.

40 Claims, 8 Drawing Sheets

IMAGE FORMING APPARATUS

FIELD OF THE INVENTION AND RELATED ART

The present invention relates to an image forming apparatus using an electrostatic image transfer means, such as an electrophotographic copying machine or printer.

An image forming apparatus is known wherein a transfer material such as paper is passed through an image transfer position formed as a nip between an image bearing member and an image transfer member contactable to the image bearing member such as an image transfer roller or belt, by which the transfer material is contacted to the transfer member, while an image transfer bias is applied to the transfer member. By this, the toner image is transferred from the image bearing member to the transfer material.

Where the image bearing member is a laser beam printer, the image bearing member in the form of a photosensitive member is uniformly charged, and then a laser beam is projected onto such a portion of the photosensitive member as is to receive the toner image, by which the electric potential of the laser beam projected portion is attenuated, so that an electrostatic latent image is formed on the photosensitive member. The electrostatic latent image is reverse-developed with toner to form a toner image, which is in turn transferred onto the transfer material.

In the image forming apparatus using the transfer roller, during a sheet absent period in which the sheet (transfer material) is absent in the image transfer position, a voltage having the polarity opposite to that during the image transfer operation being performed (the same polarity as the toner) is applied in order to prevent the toner from being deposited onto the transfer roller or to prevent production of a so-called image transfer charge memory attributable to the application of the bias voltage having the polarity opposite to the charging polarity of the image bearing member or to transfer the toner deposited on the transfer roller back to the photosensitive member. The sheet absent period includes a pre-rotation period in which the photosensitive member is rotated for the purpose of preparation for the image forming operation and during the sheet interval period, that is, the period after the image transfer on the transfer material and before the image transfer on the next transfer material in a continuous image formation mode in an image forming operation started by an image formation start signal by a copy button or the like.

One of the causes of the toner deposition on the transfer roller is that usual image forming apparatus is capable of being used with plural sizes of transfer materials, and therefore, there is a region in which the photosensitive member and the transfer roller are directly contacted.

Referring first to FIG. 5, there is shown a sequential operation. During the pre-rotation, the transfer roller is supplied with a bias voltage having the polarity, the same as that of the toner, for example, −800 V so that the residual toner remaining on the surface of the image bearing member is not deposited on the transfer roller and so that the toner deposited on the transfer roller is transferred back to the photosensitive member.

During the sheet present period subsequent thereto, a voltage having a polarity opposite to that of the toner, +500 V, for example, is applied to effect the image transfer operation.

During the sheet interval, the voltage of the polarity which is the same as that of the toner, −800 V, for example is applied.

In such an image forming apparatus, the polarity of the bias voltage applied to the transfer roller during the pre-rotation and the sheet interval, is the same as the toner regularly charged. Therefore, reverse toner, that is, the toner particles charged to the polarity opposite to the intended polarity is deposited on the transfer roller.

In the reverse-development system, if the developing bias is applied when the non-charged portion of the image bearing member is in the developing device, the portion is developed. In order to prevent this, the charging bias is applied for a period longer than the sheet passing period, as indicated by reference characters A and B at the leading edge and trailing edge of the transfer material.

As shown in FIG. 5, the charging region is wider than the developing region, and therefore, in the difference areas, i.e., the areas indicated by the reference characters A and B, the reverse toner is necessarily deposited onto the areas. The reverse toner is deposited onto the transfer roller when the transfer roller is supplied with the voltage having the polarity which is the same as that of the regular toner during the sheet absent period at the transfer position. This causes contamination of the back side of the transfer material.

In addition, where a charging roller contactable to the image bearing member is used to charge the image bearing member, the roller is sometimes contaminated, although the contamination is not as great as in the transfer roller. If this occurs, the uniform charging is not expected.

SUMMARY OF THE INVENTION

Accordingly, it is a principal object of the present invention to provide an image forming apparatus wherein the contamination of the image transfer rotatable member and the contamination of the backside of the transfer material, which are produced by contact of the rotatable member to the backside of the transfer material to transfer the toner image from the image bearing member to the transfer material.

It is another object of the present invention to provide an image forming apparatus wherein a rotatable member contactable to the image bearing member is prevented from being contaminated.

It is a further object of the present invention to provide an image forming apparatus capable of providing a good image.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
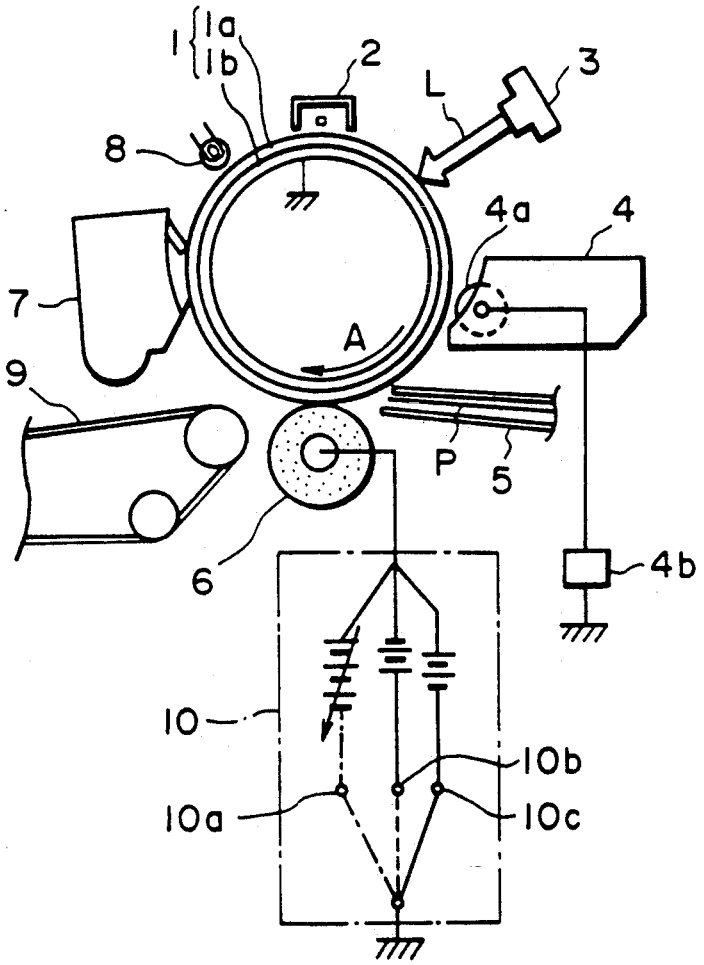
FIG. 1 is a somewhat schematic sectional view of major part of the image forming apparatus suitable for incorporation of the present invention.

Referring to FIG. 1, there is shown a laser beam printer suitable for incorporation of the present invention, as an exemplary image forming apparatus. The laser beam printer includes an image bearing member 1 in the form of a photosensitive member rotatable in the direction indicated by an arrow A about an axis extending perpendicular to the sheet of the drawing. It includes an OPC (organic photoconductor) photosensitive layer 1*a* and a conductive base 1*b* electrically grounded and made of aluminum or the like to support the photosensitive layer 1*a*. The OPC photosensitive layer of the image bearing member 1 is uniformly charged to −700 V by a primary charger 2, and the charged surface is exposed to a laser beam L modulated in accordance with image formation by a laser scanner 3, so that an electrostatic latent image is formed by attenuation of the potential down to −100 V at the exposed areas.

When the latent image reaches the developing position opposed to a developing device 4, negatively charged toner particles are supplied by a developing sleeve 4*a*, by which the toner particles are deposited on such a portion as has the attenuation potential, and a toner image is formed. To the developing sleeve 4*a* a bias voltage is applied by a voltage source 4*b*. The bias voltage is a combination of an AC voltage having a peak-to-peak voltage of 1200 V and having the frequency of 1800 Hz and a DC voltage of −460 V.

Then, the toner image reaches an image transfer position where the transfer roller 6 is press-contacted to the photosensitive member. In timed relation with this, a transfer material P is supplied to the transfer position along the conveying passage 5 including the transfer guide, and simultaneously therewith, a switch 10*a* of the voltage source 10 is operated (to the chain line position) to apply to the rotatable transfer roller a DC bias having a positive polarity (+1700−+3700 V) from the voltage source 10, by which an electric field effective to transfer the toner image from the photosensitive member onto the transfer material is formed. The transfer roller 6 has a core metal made of steel and having a diameter of 8 mm and an EPDM layer thereon having an elasticity containing carbon particles dispersed therein so as to provide a volume resistivity of $10^7$-$10^{10}$ ohm.cm and a hardness of 25-30 degrees (Asker C). The outer diameter thereof is 20 mm in this example.

Thereafter, the transfer material carrying the toner image is transported on a conveying belt 9 to an unshown image fixing station. On the other hand, the toner remaining on the photosensitive member not transferring to the transfer material at the transfer position is removed by a cleaner 7, and the electric charge remaining on the photosensitive member is removed by a pre-discharging lamp 8, so that the photosensitive member is prepared for the next image forming operation.

Figure 2:
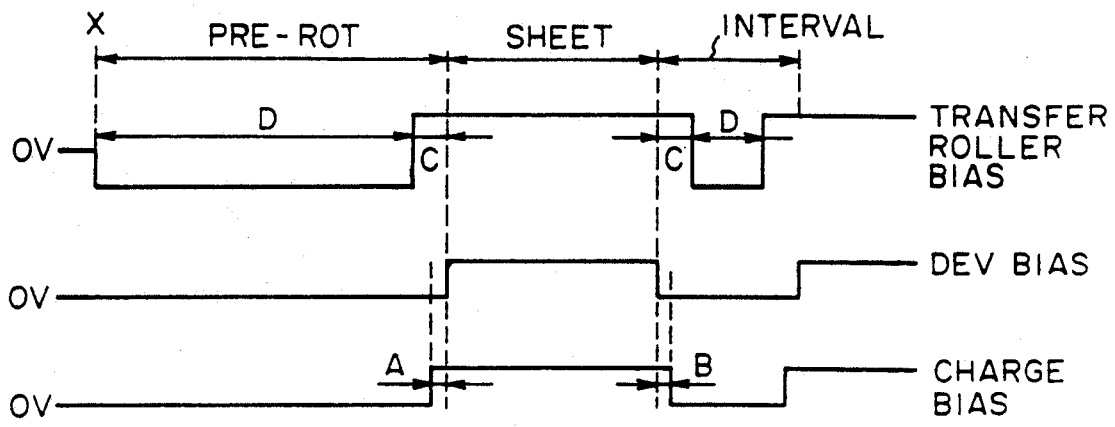
FIG. 2 is a sequential chart for illustrating an operation of the apparatus of FIG. 1.

FIG. 2 is a timing chart of the operation of the image forming apparatus. At a point X of time, the pre-rotation is started in which the photosensitive member is not charged, and the transfer material is absent at the transfer position. In this sheet absent period, the transfer roller is supplied with a DC voltage of −1500 V in this example having a polarity which is the same as the toner, by switching the voltage source 10 to a contact 10*b* (broken line) in order to form an electric field to prevent the toner particles deposited on the surface of the photosensitive member due to sheet jam or the like from transferring to the transfer roller 6 and in order to form such an electric field that negative toner particles deposited on the transfer roller 6 is transferred to the photosensitive member 1. Such a period D is longer than the time required for one full turn of the transfer roller 6. The area of the photosensitive member which passes through the transfer position during the period D, as shown in FIG. 2, is a non-image-formation area in which the toner image is not formed, but reversely charged toner particles are deposited on the photosensitive member, and the reverse toner is attracted to the transfer roller. During a time period C after the period D elapses from the time X before the sheet present period in which the transfer material (sheet) is present at the transfer position, the polarity of the bias voltage to the transfer roller 6 is switched to +1500 V DC bias, that is, the switch is changed to a contact 10*c* (solid line) side to form an electric field effective to transfer the reversely charged toner particles (positively charged toner particles) contained in the toner particles and deposited onto the transfer roller during the period D. The period C is made longer than the period required for the one full rotation of the transfer roller. As shown in FIG. 2, the area of the photosensitive member passing through the transfer position during the time period C is the non-toner-image-formation area and is an uncharged area.

As shown in FIG. 2, after start of the operation of the charging bias, the position of the photosensitive member 1 surface at the charging position moves to the developing position. After time period A elapses therefrom, the operation of the developing bias starts. When the area of the photosensitive member 1 reaches the transfer position after the start of the application of the developing bias, the leading edge of the transfer material reaches the transfer position. The operation of the developing bias stops at the time which is B before a portion of the photosensitive member 1 moves from the charging position to the developing position. When the portion of the photosensitive member 1 at which the application of the developing bias is stopped reaches the transfer position, the trailing edge of the transfer material passes through the transfer position.

As will be understood from FIG. 2, the time period C is longer than the above period A and than the period B.

Accordingly, the transfer roller is supplied with a voltage having a polarity which is the same as the reversely charged toner particles (positive) at least during the period in which the area of the photosensitive member to which the reversely charged toner particles are deposited by the developing device during the periods A and B. Therefore, an electric field not attracting the reversely charged toner particles onto the transfer roller 6 is formed, so that the contamination of the transfer roller 6 can be prevented.

The quantity of regularly charged toner particles is larger than the quantity of the reversely charged toner particles, and therefore, the quantity of the regularly charged particles deposited on the transfer roller is larger than that of the reversely charged toner particles. For this reason, in many cases, reversely charged toner particles are deposited on the transfer roller, and the regularly charged toner particles are deposited on the reversely charged toner particles. In consideration of this, it is preferable that the reversely charged toner particles are removed after the regularly charged toner particles are removed from the transfer roller, as shown in FIG. 2. In addition, it is preferable that the time period D in which the regularly charged particles are removed is longer than the period C in which the reversely charged toner particles are removed.

Although not shown in the drawing, the above-described operation can be performed during a so-called post-rotation period.

As described in the foregoing, a bias voltage having the same polarity as the regularly charged toner particles is applied for a period not less than the period required for one full rotation of the transfer roller, and an opposite polarity voltage is applied to the transfer roller for a period which is longer than the period required for one full turn of the transfer roller, during the pre-rotation period, the post-rotation period and/or the sheet interval period. By doing so, an electric field is formed between the photosensitive member and the transfer roller, which is effective to remove from the transfer roller both of the regularly charged and reversely charged toner particles deposited on the transfer roller. Therefore, stabilized and good image transfer operation can be performed for a long period of time. In addition, the subsequent transfer material is not contaminated at its backside. It is not inevitable that the transfer roller is supplied with a bias voltage. For example, the transfer roller may be grounded whereas the potential of the photosensitive member contacted to the transfer roller is placed at a predetermined level to remove the regularly charged toner particles and reversely charged toner particles.

Figure 3:
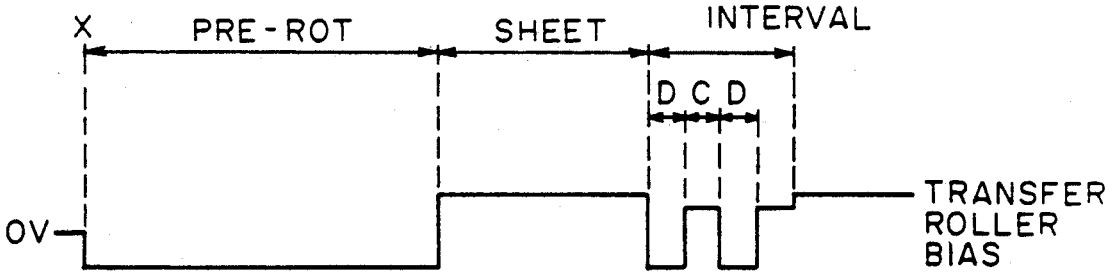
FIG. 3 is a sequential time chart illustrating an operation in an apparatus according to another embodiment of the present invention.

FIG. 3 is a timing chart illustrating another embodiment of the present invention.

In the system shown in this Figure, the point of time at which the bias voltage having the same polarity as in the image transfer operation is applied (time C in the foregoing embodiment) is not in a period continuing from the sheet passage period.

More particularly, the positive and negative bias voltages are continuously applied for the period (C, D) exceeding the period required for the one full turn of the transfer roller. By doing so, both of the regularly charged toner particles and the reversely charged toner particles are removed in this order. This is executed in the sheet interval period.

It is possible that the bias level during the period C may be lowered to such a level that the memory on the photosensitive member is not easily produced. From this standpoint, it is preferable that the bias level in the period C is made lower than that during D.

Figure 4:
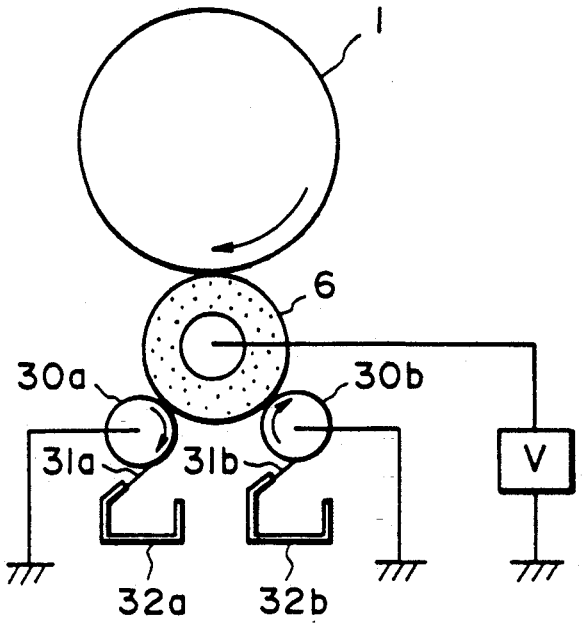
FIGS. 4 and 13 are somewhat schematic side views of major parts of image forming apparatuses according to further embodiments of the present invention.
Figure 5:
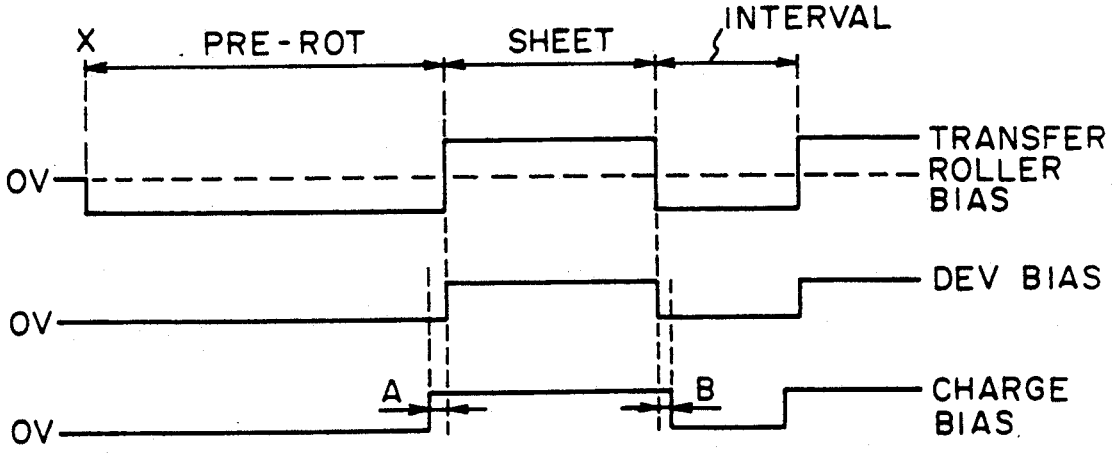
FIG. 5 is a time chart illustrating an operation of a comparison example apparatus, for the purpose of contrasting to the time chart of FIG. 2.

FIG. 4 shows a further embodiment in which a photosensitive member 1 and a transfer roller 6 and the structure therearound only are shown.

Where the diameter of the transfer roller is large as compared with the diameter of the photosensitive member, where the period of the sheet interval is short or the like, it may be difficult that the transfer roller is rotated through one full turn while the positive bias voltage is applied, and an additional one full turn while the negative bias voltage is applied.

FIG. 4 embodiment is suitable for such cases. In this embodiment, electrode rollers **30*a* and 30*b* made of electrically conductive material such as metal which are electrically grounded are contacted to the transfer roller 6. To the electrode rollers 30*a* and 30*b* mounted on the toner container 32*a* and 32*b* are contacted. According to this embodiment, the number of portions for removing the toner from the transfer roller is three, more particularly, one at the contact portion between the transfer roller and the photosensitive member, and two at the contact portions between the electrode rollers and the transfer roller. By distributing the three contact portions at circumferentially equidistant positions, the time period required for covering the entire surface of the transfer roller 1 becomes one third. The order of the bias voltages applied to the transfer roller is the same as in FIGS. 2 and 3**.

On the other hand, the transfer roller is easily influenced by ambient humidity. More particularly, the roller having a length of 220 mm was press-contacted to a flat conductive plate to form a nip therebetween having a nip width of 2 mm, and a voltage of 1 KV was applied between them. Then, the electric resistance was measured. It was approximately $10^9$ ohm under a low humidity and low temperature condition, approximately $4\times10^8$ ohm under a normal humidity and normal temperature condition, and approximately $5\times10^7$–$10\times10^7$ ohm under a high humidity and high temperature condition.

The resistances are different if the material and the transfer roller producing method are different. However, the change in the resistance is not easily compensated by changing the material or the producing method. Therefore, it is preferable that the transfer bias voltage level is changed in accordance with the ambient condition. An example of this will be described.

During the sheet absent period in which the transfer material is absent at the transfer position, such as the pre-rotation period or the sheet interval period between adjacent transfer materials when the printing is effected continuously on the plural transfer materials, a voltage having the same polarity as the primary charger 2 is applied to the transfer roller 6, and the electric current through the transfer roller 6 is measured to predict the resistance of the roller. On the basis of the predicted electric resistance of the transfer roller, the proper transfer bias voltage is determined for the subsequent sheet passage period, and the determined voltage is applied to the transfer roller.

Figure 6:
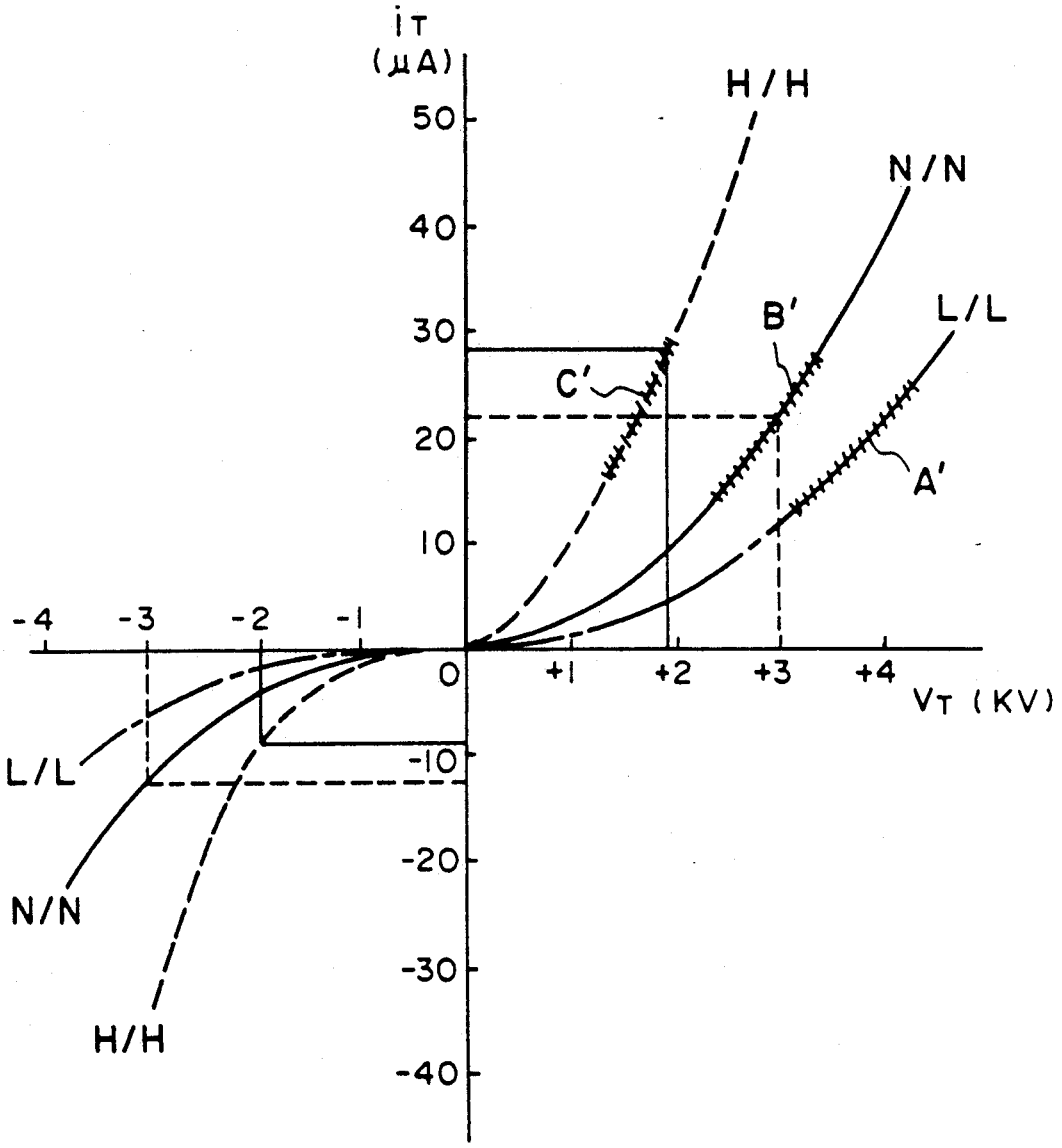
FIG. 6 is a graph showing a different in the current-voltage characteristics due to the difference in the ambient condition.

FIG. 6 shows a current-voltage characteristic between the transfer member 1 and the transfer roller 6. The areas indicated by references A', B' and C' are the areas in which good image transfer can be provided under the low temperature and low humidity condition (15° C., 10% RH), normal temperature and normal humidity condition (23° C., 60% RH) and the high temperature and high humidity condition (32° C., 85% RH), respectively. The process speed, that is, the peripheral speed of the photosensitive member surface is 92 mm/sec.

Here, the reason why the current is small when the negative voltage is applied to the transfer roller is that the current is the one when the photosensitive member is negatively charged beforehand (usually −600 V approximately), and that the photosensitive member and the transfer roller have a slight rectifying property.

Figure 7:
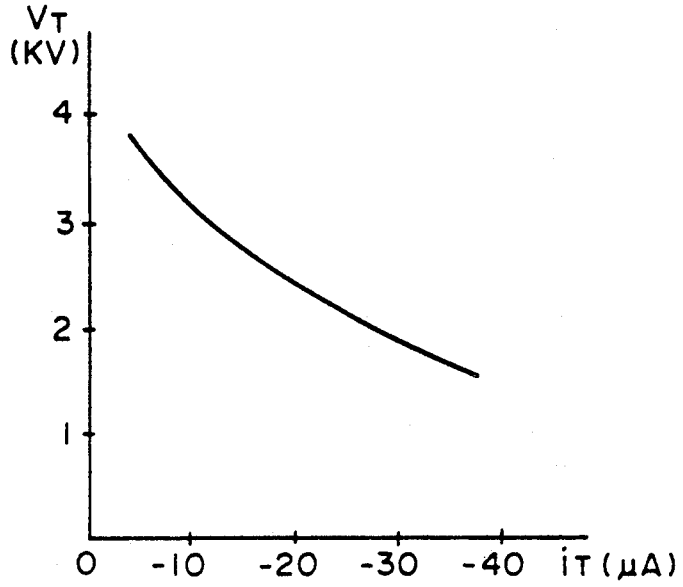
FIG. 7 is a graph illustrating a proper voltage to be applied to the transfer roller.

FIG. 7 shows the optimum transfer voltages relative to the current through the transfer roller when the transfer roller is supplied with a constant voltage of −3 KV when the transfer roller is not present at the transfer position.

Thus, even if the electric resistance of the transfer roller changes due to the ambient condition change, the proper transfer bias can be determined on the basis of the current which is measured when the voltage having the predetermined level and having the same polarity as the charger is applied to the transfer roller in a proper bias setting period positively provided during the pre-rotation period and/or the sheet interval period.

Figure 8:
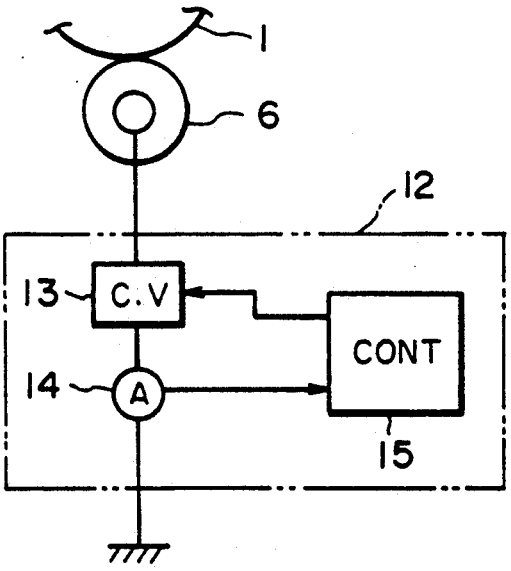
FIG. 8 is a schematic view of a structure around the transfer position.

FIG. 8 shows an apparatus for implementing incrementing this method. A bias voltage applying means 12 includes a voltage changeable source 13, an ammeter 14 and a controller 15. During the pre-rotation, the transfer roller 6 is supplied with a constant voltage of −3 KV. The electric current at this time is measured by the ammeter 14. A voltage level corresponding to the measured current is determined using the graph of FIG. 7. The thus determined transfer bias is applied during the transfer operation for the first sheet. In FIG. 8, the voltage source 13, as described hereinbefore, is capable of applying to the transfer roller voltages for removing the regularly charged toner particles and reversely charged toner particles from the transfer roller, respectively.

The current may be determined as an average of the current in all of the period in which the −3 KV voltage is applied, or may be determined from the current in a sampling period.

Similarly, the −3 KV is applied also in the sheet interval period between the first sheet and the second sheet. From the current at this time, the transfer bias to be applied for the second sheet is determined.

To obtain a voltage $V_T$ from the measured current $i_T$ by the controller, an analog linear processing circuit may be used to calculate $V_T = -i_T \times \alpha + \beta$ ($\alpha$, $\beta$: constants), the voltage $V_T$ may be determined using a digital computer or using a look-up table.

According to this embodiment, the bias voltage having the same polarity as the charger is applied during the sheet interval period, and therefore, the transfer memory is not produced.

Before the transfer bias is set, it is preferable that the transfer roller is cleaned. This is because, if the transfer bias is set with the transfer roller being contaminated, the prediction of the electric resistance of the transfer roller under the condition is deviated more from the actual resistance thereof due to the toner particles or the like deposited on the transfer roller. It is probable that the transfer roller is extremely contaminated when jam occurs. This embodiment is suitable in view of such occurrences.

Figure 9:
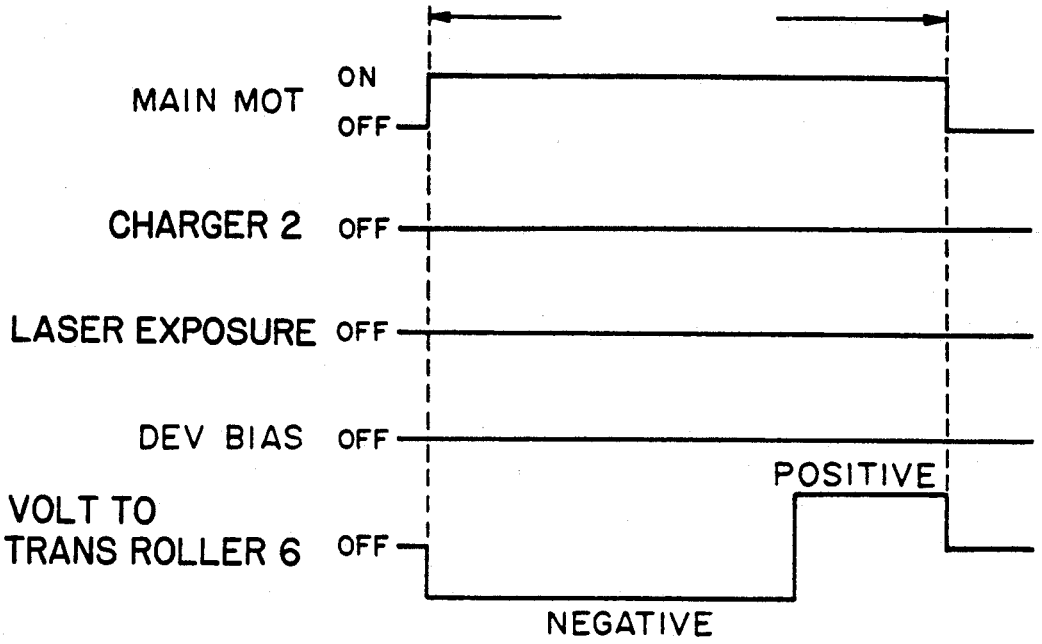
FIGS. 9 and 12 are timing charts according to another embodiment of the present invention.

As shown in FIG. 9, after the main switch is actuated, the preparation rotation is performed, during which the charger 2 is not energized to maintain substantially zero potential at the surface of the photosensitive member. It is preferable that at this time the pre-exposure lamp 8 is turned on in synchronization with the main motor.

It is preferable that the preparation rotation is started when a heating roller usually provided with a heating source press-contacted to a back-up roller of an image fixing apparatus reaches a predetermined temperature, since the back-up roller can be heated.

Upon start of the preparation rotation, the transfer roller 6 is first supplied with a constant voltage of −3 KV for at least one rotation of the transfer roller after actuation of the main switch. By doing so, an electric field effective to transfer the regularly charged toner particles (negatively charged) from the transfer roller to the photosensitive member is formed, so that the transfer roller can be effectively cleaned. This is enhanced by the fact that the photosensitive member is not charged (substantially 0 V).

Then, the voltage applied to the transfer roller is switched to +3 KV, and the transfer roller is rotated through at least one full turn. By doing so, an electric field is formed which is effective to transfer the reversely charged toner (positively charged toner, in this case, which may result in production of foggy background) in the toner particles from the transfer roller to the photosensitive member 1, by which the surface of the transfer roller can be sufficiently cleaned.

In this process, the electric resistance of the transfer roller is predicted during the period in which the transfer roller is supplied with a negative voltage, and the proper image transfer voltage can be determined on the basis of the prediction. It is possible that the electric resistance of the transfer roller is predicted during the period in which the positive voltage is applied or that the resistance of the transfer roller is predicted after the regular toner and the reversely charged toner are removed.

In this case, the surface of the photosensitive member 1 is at zero potential, and therefore, the transfer current when the negative voltage is applied to the transfer roller is larger than in the case of FIG. 6, and therefore, the accuracy of the determination of the optimum transfer voltage is improved.

Figure 10:
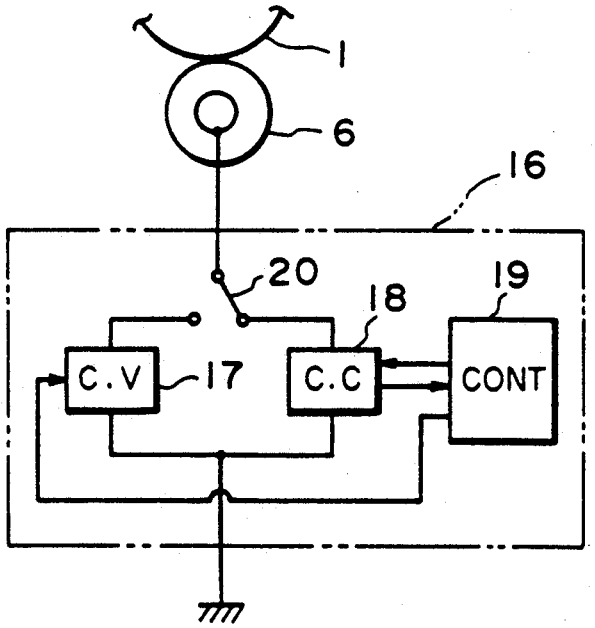
FIG. 10 is a schematic view of a structure around the transfer position according to a further embodiment.

Referring to FIG. 10, another example of determining the optimum transfer voltage will be described. In the apparatus of this example, the means 16 for applying the bias voltage to the transfer roller 6 includes a constant voltage source 17, a constant current source 18 of negative polarity and a controller 19 for setting a current level of the constant current source 18, for detecting a voltage of the source 18 and for setting a voltage level of the constant voltage source 17. It also includes a switch 20 for selecting the voltage sources. The constant voltage source 17 is capable of applying to the transfer roller the voltages effective to remove the regularly charged toner particles and for removing the reversely charged toner particles, respectively.

The current source 18 is so set that the constant current of −10 micro-ampere is provided. Then, the voltage at this time ranges between approximately −3.5 KV−−2 KV, as will be understood from the graph of FIG. 6. The optimum voltage for the transfer is the ones within the hatched area of FIG. 6 in the positive voltage regions. It changes between +3.7−+1.7 KV depending on the ambient conditions.

Figure 11:
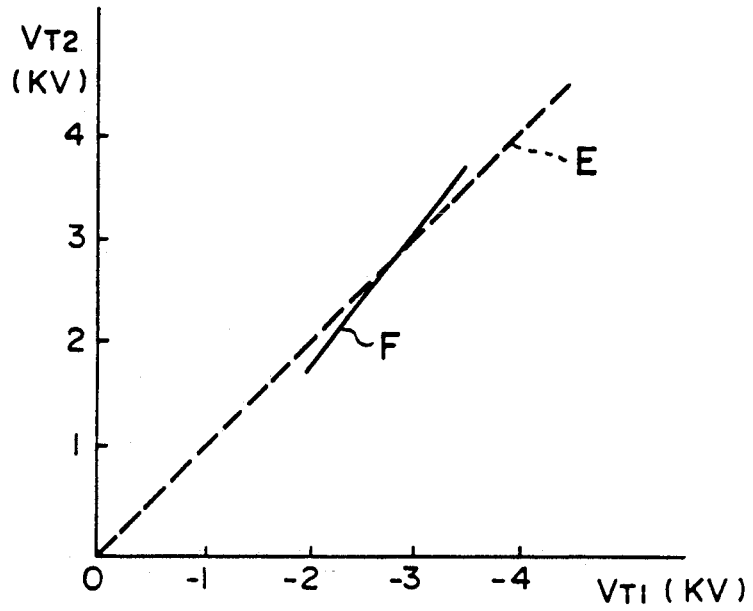
FIG. 11 is a graph showing the operation of the above structure.
Figure 12:
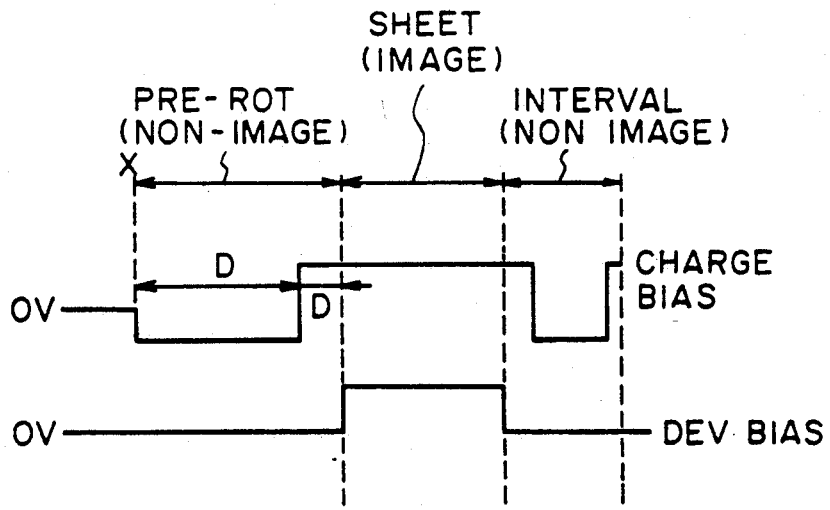

FIG. 11 shows this by a solid line D. In this Figure, the abscissa represents an output voltage $V_{T1}$ (negative voltage), and the ordinate represents the optimum transfer voltage $V_{T2}$ (positive voltage) predicted from it.

The broken line E approximates the solid line F. By using this, the controller 19 can easily determine the voltage to be provided by the constant voltage source 17 on the basis of the output voltage $V_{T1}$ of the constant current source 18 and using $V_{T2} = -\alpha \times V_{T1}$ ($\alpha$: constant).

The timing of the detection of the voltage $V_{T1}$ is such that the constant current is supplied during the pre-rotation period or the sheet interval as described in the foregoing, and the voltage at this time is detected as the voltage $V_{T1}$, and the voltage $V_{T2}$ is determined on the basis of the voltage $V_{T1}$ in the manner described above, and the obtained voltage is applied to the subsequent image transfer operation.

As will be understood from FIG. 6, the optimum transfer bias level changes substantially if the ambient conditions change. However, the current $i_T$ is substantially concentrated around 20 micro-amperes. Therefore, it can be said that the optimum transfer bias is preferably determined on the basis of the current.

Therefore, the optimum voltage setting on the basis of the constant current control is more reliable.

Figure 13:
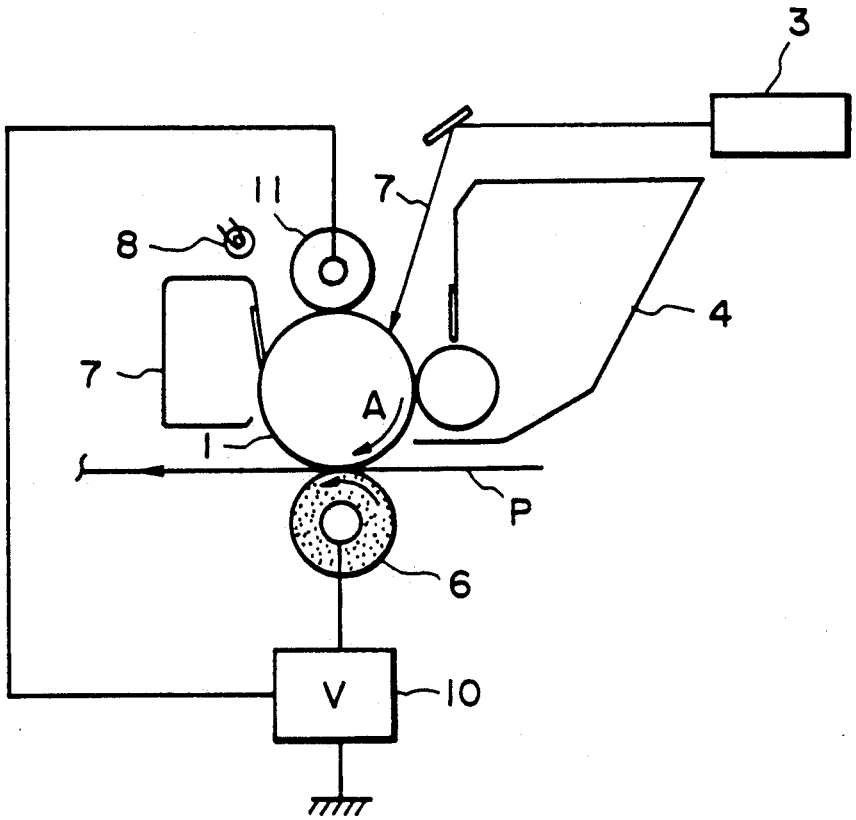

In the foregoing embodiments, the photosensitive layer is made of an organic photoconductor, and the image is formed through the reverse development. However, the present invention is not limited to such a case. Rather, it is applicable to the case where another photosensitive material such as Se or amorphous silicon, or where the regular development system is used. The foregoing description has been made with respect to the transfer roller in which the present invention is embodied. However, it is readily understood that the present invention is applicable to the case where the charging roller 11 is used as the primary charging means, as shown in FIG. 13. The cleaning of the charging roller is effected for the regularly charged toner particles and for the reversely charged toner particles similarly to the foregoing, in the non-image-formation area in which the toner image is not formed, when the contact portion between the photosensitive member and the charging roller reaches the developing position.

In the foregoing embodiment, the description has been made as to the case in which the transfer means is in the form of a transfer roller. However, the present invention is not limited to the roller type transfer means or the roller type charging means. The present invention is applicable to the transfer belt or to the charging belt.

The transfer member such as transfer roller may be out of contact with the image bearing member, and the clearance between the transfer member and the image bearing member may be set to be smaller than the transfer material such as paper.

The developer usually contains the reversely charged toner particles both in one component developer and two component developer (toner and carrier particles), and therefore, the present invention is applicable to both cases.

Also, the present invention is applicable to the case wherein after the toner image is temporarily transferred from the photosensitive member to a belt, and the toner image transferred to the belt is further transferred to the transfer material using a transfer roller. The transfer roller may be cleaned using the present invention.

As described in the foregoing, according to the present invention, the transfer member is supplied with a bias voltage at least for a period required for one full turn of the roller, and then, the polarity of the voltage is switched, and then, the voltage is applied at least for a period required for one turn of the transfer member. By this, the surface of the transfer member is kept from deposition of the regularly charged toner particles and the reversely charged toner particles. Therefore, the stabilized image transfer operation is possible at all times. In addition, the contamination of the backside of the transfer material can be prevented.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

a movable image bearing member;

image forming means for forming a toner image having a plurality on said image bearing member; and image transfer means for transferring the toner image onto a transfer material at a transfer position, said transfer means including a rotatable member contactable to such a side of the transfer material as is opposite from a side contactable to said image bearing member and electric field forming means for forming an electric field between said image bearing member and said rotatable member, wherein said electric field forming means forms a first electric field effective to transfer toner having the same polarity as the polarity of the toner image on said image bearing member from said rotatable member to said image bearing member and a second electric field which is opposite in direction from the first electric field during a period in which the transfer material is absent at the transfer position, and wherein the period in which the first electric field is formed and the period in which the second electric field is formed are adjacent to each other, each of said first and second electric fields is formed at least for a period required for substantially the entire circumferential surface of said rotatable member to pass through the transfer position.

2. An apparatus according to claim 1, wherein said rotatable member is contactable to said image bearing member.

3. An apparatus according to claim 1, wherein said rotatable member is in the form of a roller.

4. An apparatus according to claim 1, wherein said electric field forming means forms said second electric field immediately after said first electric field is formed.

5. An apparatus according to claim 4, wherein said electric field forming means forms said second electric field subsequent to the formation of the first electric field.

6. An apparatus according to claim 1, wherein said electric field forming means forms an image transfer electric field between said image bearing member and said rotatable member when the transfer material is present at the transfer position by applying a voltage to said rotatable member having a polarity opposite to a polarity of toner having the same charging polarity as the polarity of the toner image on said image bearing member, and prior to the formation of the transfer electric field, said first and second electric fields are formed.

7. An apparatus according to claim 6, wherein said image forming means includes a latent image forming means for forming a latent image on said image bearing member and developing means for developing the latent image with the toner, and said latent image forming means includes means for charging said image bearing member.

8. An apparatus according to claim 7, wherein said charging means has a charging polarity which is the same as the charging polarity of the toner having the same polarity as the polarity of the toner image on said image bearing member.

9. An apparatus according to claim 8, wherein a length, measured in a direction of movement of said image bearing member, of an area charged by said charging means contains and is larger than a length, measured in the same direction, of an area of said image bearing member to be developed by said developing means.

10. An apparatus according to claim 1, wherein said electric field forming means applies a voltage having the same polarity as toner having the same polarity as the polarity of the toner image on said image bearing member to said rotatable member when said first electric field is formed.

11. An apparatus according to claim 1 or 10, wherein said electric field forming means applies to said rotatable member a voltage having a polarity opposite to a polarity of toner having the same polarity as the polarity of the toner image on said image bearing member, when said second electric field is formed.

12. An apparatus according to claim 1, wherein said electric field forming means applies a DC voltage between said image bearing member and said rotatable member.

13. An apparatus according to claim 1, wherein said electric field forming means applies said first and second electric fields during a period in which the transfer material is absent at the transfer position during an image forming operation responsive to an image formation start signal, after passage of a transfer material through the transfer position and before the next transfer material reaches the transfer position.

14. An image forming apparatus according to claim 1, wherein said electric field forming means forms said first electric field for a longer period than said second electric field.

15. An apparatus according to claim 1, further comprising cleaning means for cleaning said image bearing member.

16. An image forming apparatus, comprising:

a movable image bearing member;

a rotatable member contactable to said image bearing member;

image forming means for forming a toner image on said image bearing member with toner having a polarity; and electric field forming means for forming an electric field between said rotatable member and said image bearing member, said electric field forming means forming a first electric field effective to transfer toner having the same polarity as the polarity of the toner image on said image bearing member from said rotatable member to said image bearing member and a second electric field having a polarity opposite to said first electric field during a period in which an area of said image bearing member in which said image forming means does not form the image is at a contact position between said rotatable member and said image bearing member, wherein the period in which the first electric field is formed and the period in which the second electric field is formed are adjacent to each other, each of said first and second electric fields is formed at least for a period required for substantially the entire circumferential surface of said rotatable member to pass through the contactable position.

17. An apparatus according to claim 16, wherein said rotatable member and said electric field forming means constitutes a charging means for charging an image forming area of said image bearing member.

18. An apparatus according to claim 17, wherein said electric field forming means forms said first and second electric fields prior to charging of the image formation area of said image bearing member by said rotatable member and said electric field forming means.

19. An apparatus according to claim 16, wherein said rotatable member is in the form of a roller.

20. An apparatus according to claim 16, wherein said electric field forming means forms said second electric field immediately after said first electric field is formed.

21. An apparatus according to claim 16, wherein said electric field forming means forms said second electric field subsequent to formation of said first electric field.

22. An apparatus according to claim 16, wherein said electric field forming means forms said first electric field for a period longer than the second electric field.

23. An apparatus according to claim 16, further comprising means for cleaning said image bearing member.

24. An image forming apparatus, comprising:

a movable image bearing member;

a rotatable member contactable to said image bearing member at a first contactable position;

image forming means for forming a toner image on said image bearing member with toner having a polarity;

plural contact members contactable to said rotatable member at respective second contactable positions;

electric field forming means for forming an electric field between said rotatable member and at least one of said contact members, said electric field forming means forming a first electric field effective to transfer toner having the same polarity as the polarity of the toner image on said image bearing member from said rotatable member to said at least one contact member and a second electric field which is opposite in direction from said first electric field during a period in which an area of said image bearing member in which said image forming means does not form the toner image is at the first contactable position, wherein each of said first and second electric fields is formed at least for a period required for substantially the entire circumferential surface of said rotatable member to pass through at least one of the second contactable positions.

25. An apparatus according to claim 24, wherein said rotatable member is in the form of a roller.

26. An apparatus according to claim 24, wherein said electric field forming means forms said second electric field immediately after said first electric field is formed.

27. An apparatus according to claim 24, wherein said electric field forming means forms said second electric field subsequent to the formation of said first electric field.

28. An apparatus according to claim 24, wherein said rotatable member and said electric field forming means constitute image transfer means for transferring the toner image onto a transfer material, and said electric field forming means forming an image transfer electric field when the transfer material is present between said image bearing member and said rotatable member.

29. An apparatus according to claim 28, wherein said electric field forming means forms said first and second electric fields prior to formation of the transfer electric field.

30. An apparatus according to claim 24, wherein said contact members are in the form of rollers.

31. An apparatus according to claim 24, wherein said contact members are electrically conductive members which are grounded.

32. An image forming apparatus, comprising:

plural contact members contactable to a rotatable member at respective contactable positions;

image forming means for forming a toner image on a first one of said plural contact members with toner having a polarity;

electric field forming means for forming an electric field between the rotatable member and at least a second one of said contact members, said electric field forming means forming a first electric field effective to transfer toner having the same polarity as the polarity of the toner image on said first contact member from the rotatable member to said second contact member and a second electric field which is opposite in direction from said first electric field during a period in which an area of said first contact member in which said image forming means does not form the toner image is at its respective contactable position, wherein each of said first and second electric fields is formed at least for a period required for substantially the entire circumferential surface of said rotatable member to pass through at least one of the contactable positions.

33. An apparatus according to claim 24 or 32, further comprising means for cleaning said contact members.

34. An image forming apparatus, comprising:

a movable image bearing member;

image forming means for forming a toner image having a plurality on said image bearing member; and image transfer means for transferring the toner image onto a transfer material at a transfer position, said transfer means including a rotatable member contactable to a side of the transfer material which is opposite from a side contactable to said image bearing member and electric field forming means for forming an electric field between said image bearing member and said rotatable member, wherein said electric field forming means forms a first electric field effective to transfer toner having the same polarity as the polarity of the toner image on said image bearing member from said rotatable member to said image bearing member and a second electric field with a polarity opposite to the first electric field after forming said first electric field, said first and second electric fields being formed when the transfer material is not present at the transfer position, wherein the transfer material reaches the transfer position after at least one full turn of said rotatable member after commencing formation of the second electric field.

35. An apparatus according to claim 34, wherein said rotatable member is contactable to said image bearing member.

36. An apparatus according to claim 34, wherein said rotatable member is in the form of a roller.

37. An apparatus according to claim 34, wherein said electric field forming means applies a voltage having the same polarity as the toner image to said rotatable member when said first electric field is formed.

38. An apparatus according to claim 34, wherein said electric field forming means applies a DC voltage between said image bearing member and said rotatable member.

39. An apparatus according to claim 34, further comprising cleaning means for cleaning said image bearing member.

40. An image forming apparatus, comprising:

a movable image bearing member;

a rotatable member contactable to said image bearing member at a first contactable position;

image forming means for forming a toner image on said image bearing member with toner having a polarity;

plural contact members each contactable to said rotatable member at respective second contactable positions; and electric field forming means for forming an electric field between said rotatable member and said plural contact members, said electric field forming means forming an electric field effective to transfer toner from said rotatable member to said plural contact members during a period in which an area of the image bearing member in which said image forming means does not form the toner image is at the first contactable position, wherein said electric field is formed at least for a period required for substantially the entire circumferential surface of said rotatable member to pass through at least one of the second contactable positions.

* * * * *

UNITED STATES PATENT AND TRADEMARK OFFICE

CERTIFICATE OF CORRECTION

PATENT NO. : 5,253,022

DATED : October 12, 1993

INVENTOR(S) : Akihiko Takeuchi, et al.

It is certified that error appears in the above-identified patent and that said Letters Patent is hereby corrected as shown below:

On the title page:

Item: [57] Abstract, second line from the bottom, "passes" should read --pass--.

COLUMN 9

Line 12, "and" should be deleted; and
Line 13, "and" should be deleted; and

COLUMN 10

Line 21, "plurality" should read --polarity--; and
Line 65, "charging" should be deleted;

UNITED STATES PATENT AND TRADEMARK OFFICE

CERTIFICATE OF CORRECTION

PATENT NO. : 5,253,022

DATED : October 12, 1993

INVENTOR(S) : Akihiko Takeuchi, et al.

It is certified that error appears in the above-identified patent and that said Letters Patent is hereby corrected as shown below:

COLUMN 13

Line 46, "plurality" should read --polarity--.

Signed and Sealed this

Seventh Day of June, 1994

Bruce Lehman

*Attest:*

BRUCE LEHMAN

*Attesting Officer*

*Commissioner of Patents and Trademarks*